United States Patent [19]

McClintock

[11] Patent Number: 4,593,757

[45] Date of Patent: Jun. 10, 1986

[54] ROD BAFFLE HEAT EXCHANGE APPARATUS AND METHOD

[75] Inventor: William A. McClintock, Bartlesville, Okla.

[73] Assignee: Phillips Petroleum Company, Bartlesville, Okla.

[21] Appl. No.: 662,866

[22] Filed: Oct. 19, 1984

[51] Int. Cl.[4] ..... F28F 9/00

[52] U.S. Cl. ..... 165/162; 165/159

[58] Field of Search ..... 165/109 R, 109 T, 159, 165/161, 162, 172

[56] References Cited

U.S. PATENT DOCUMENTS

| | | | |
|---|---|---|---|
| 1,641,999 | 9/1927 | Webster | 165/161 |
| 1,882,474 | 10/1932 | Black | 165/162 X |
| 2,018,037 | 10/1935 | Sieder | 165/82 |
| 2,229,344 | 1/1941 | Schneider | 165/162 |
| 3,351,131 | 11/1967 | Berthold | 165/174 X |
| 3,706,534 | 12/1972 | Verheul et al. | 165/174 X |
| 4,127,165 | 11/1978 | Small | 165/162 |
| 4,136,736 | 1/1979 | Small | 165/162 |
| 4,256,783 | 3/1981 | Takada et al. | 165/162 X |
| 4,289,198 | 9/1981 | Young | 165/159 |
| 4,398,595 | 8/1983 | Small | 165/162 X |

FOREIGN PATENT DOCUMENTS

| | | | |
|---|---|---|---|
| 0099692 | 6/1983 | Japan | 165/162 |
| 553485 | 5/1943 | United Kingdom | 165/162 |

*Primary Examiner*—Albert W. Davis, Jr.
*Assistant Examiner*—Randolph A. Smith
*Attorney, Agent, or Firm*—Stephen E. Reiter

[57] ABSTRACT

A novel supported tube bundle, useful for improving the shell fluid flow distribution in a shell and tube heat exchanger is improved by varying the number and position of rods that comprise the rod baffles in the heat exchanger. The number and position of rods are varied to provide fewer rods adjacent the inlet and outlet of the shell than at other portions of the shell so that flow of shell fluid through areas where the flow normally tends to channel is diverted to areas where flow normally tends to by-pass.

20 Claims, 11 Drawing Figures

ROD BAFFLE HEAT EXCHANGE APPARATUS AND METHOD

BACKGROUND

1. Field of Invention

This invention relates to heat exchange apparatus and method. The invention also relates to apparatus and method for improving the flow distribution of shell fluid in a shell and tube heat exchanger.

2. Description of the Prior Art

Heat transfer is an important part of many processes. As is well known, indirect transfer of heat from one medium to another is usually accomplished by the use of heat exchangers, of which there are many types such as for example double pipe, shell and tube, plate heat exchangers and the like. Although the art of heat exchanger design is highly developed, there remains room for improvement in a number of areas such as for example reducing pressure drop, increasing overall heat transfer coefficients, reducing fouling, and the like. In heat exchangers utilizing a tube bundle, such as shell and tube heat exchangers, improving fluid flow distribution as well as tube support are areas where room for improvement exists. The present invention is particularly concerned with improving the flow distribution and thus improving heat transfer efficiency of shell fluid in a shell and tube heat exchanger.

A shell and tube heat exchanger typically comprises a cylindrical shell, an approximately cylindrical bundle of tubes longitudinally disposed within the shell, means for supporting the tubes in the shell, inlet and outlet means for introducing a first fluid to and withdrawing the first fluid from the tubes, and inlet and outlet means for introducing a second fluid to and withdrawing the second fluid from the interior of the shell. Indirect heat exchange between the first and second fluids is effected by passing one fluid through the tubes while passing the other fluid through the shell, wherein the first and second fluids can be passed through the tubes and shell in either concurrent or countercurrent flow relation. For purposes of nomenclature, the fluid that passes through the tubes is referred to herein as the tube fluid. Similarly, the fluid that passes through the shell is referred to herein as the shell fluid. The flow path of the shell fluid is referred to herein as the normal flow path.

The art has heretofore recognized the need to maximize the area of contact between the flowing shell fluid and the tubes in order to maximize heat exchange efficiency. Because of the low pressure drop and lack of resistance to flow along the path between the inlet and outlet of the shell side of the heat exchanger, the flowing shell fluid substantially by-passes areas near the shell fluid inlet and outlet. This channeling of flow adversely affects heat exchange efficiency. The areas of the heat exchanger apparatus which are by-passed when fluid flows along the normal flow path are referred to herein as the normally by-passed areas, as illustrated by areas 3 and 4 in FIG. 1.

In FIG. 1, the shell of a typical shell and tube heat exchanger is indicated by the numeral 1. For simplicity, the tubes and rod baffles are not shown. It is assumed that the rod baffles are evenly distributed across the shell and that the number of rods employed in each baffle is approximately the seam. The normal flow path 2 of shell fluid through the heat exchanger tends to channel and by-pass the normally by-passed areas designated 3 and 4. As a result, the portions of those tubes passing through normally by-passed areas 3 and 4 are not in good contact with the flowing shell fluid. Accordingly, it is desired to divert shell fluid flow to the normally by-passed areas 3 and 4 in order to increase overall heat exchange efficiency.

OBJECTS OF THE INVENTION

It is therefore an object of this invention to provide a shell and tube heat exchanger with improved heat exchange efficiency.

Another object of the invention is a method and apparatus for diverting shell fluid from the normal flow path to normally by-passed areas on the shell side of a shell and tube heat exchanger.

Other objects, aspects, as well as the several advantages of the invention will be apparent to those skilled in the art upon reading the specification, drawings and the appended claims.

STATEMENT OF THE INVENTION

In accordance with the present invention, I have discovered that the heat exchange efficiency of a shell and tube heat exchanger can be increased by positioning a greater density of support elements or flow deflecting rods in the portion of the heat exchanger where flow tends to channel with a corresponding reduced density of support elements or flow deflecting rods in the portion of the heat exchanger where flow tends to by-pass.

DETAILED DESCRIPTION OF THE INVENTION

In accordance with one embodiment of the invention, a supported tube bundle having a first end portion and a second end portion is provided, wherein the density of support elements in the center portion of the tube bundle is higher than the density of support elements in the first and second end portions.

In accordance with another embodiment of the invention, a shell and tube heat exchanger is provided wherein the number and position of rods in the rod baffles are varied in such a manner as to at least partially impede the flow of shell fluid through areas in which flow tends to channel.

In accordance with yet another embodiment of the invention, a method for reducing the channeling of shell fluid and improving the heat transfer efficiency of a shell and tube heat exchanger is provided employing a shell and tube heat exchanger wherein the number and position of rods in the rod baffles are varied in such a manner as to at least partially impede the flow of shell fluid through areas in which flow tends to channel.

Figure 1:
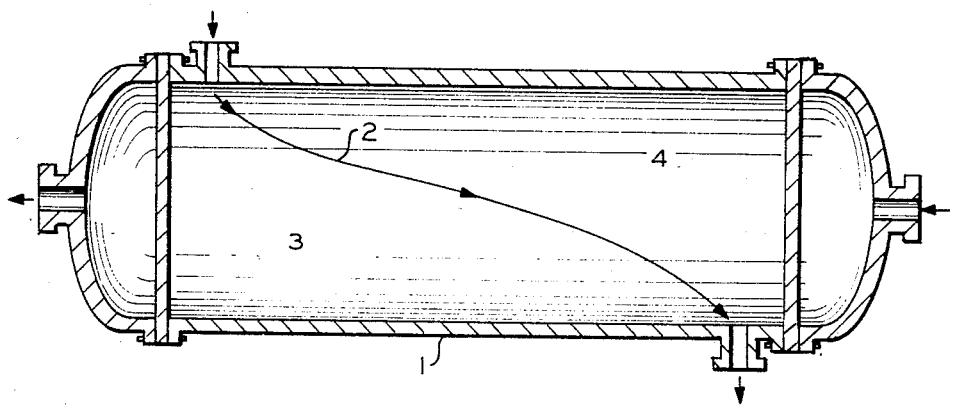
FIG. 1 PRIOR ART
FIG. 1 is a cross sectional elevational view which shows the shell of a prior art shell and tube heat exchanger without the tubes; the figure also illustrates the normal flow path of shell fluid.

In FIG. 1, the shell of a typical shell and tube heat exchanger is indicated by the numeral 1. For simplicity, the tubes and rod baffles are not shown. It is assumed that the rod baffles are evenly distributed across the shell and that the number of rods employed in each baffle is approximately the same. The normal flow path 2 of shell fluid through the heat exchanger tends to channel and by-pass the normally by-passed areas designated 3 and 4. As a result, the portions of those tubes passing through normally by-passed areas 3 and 4 are not in good contact with the flowing shell fluid. Accordingly, it is desired to divert shell fluid flow to the normally by-passed areas 3 and 4 in order to increase overall heat exchange efficiency.

Figure 2:
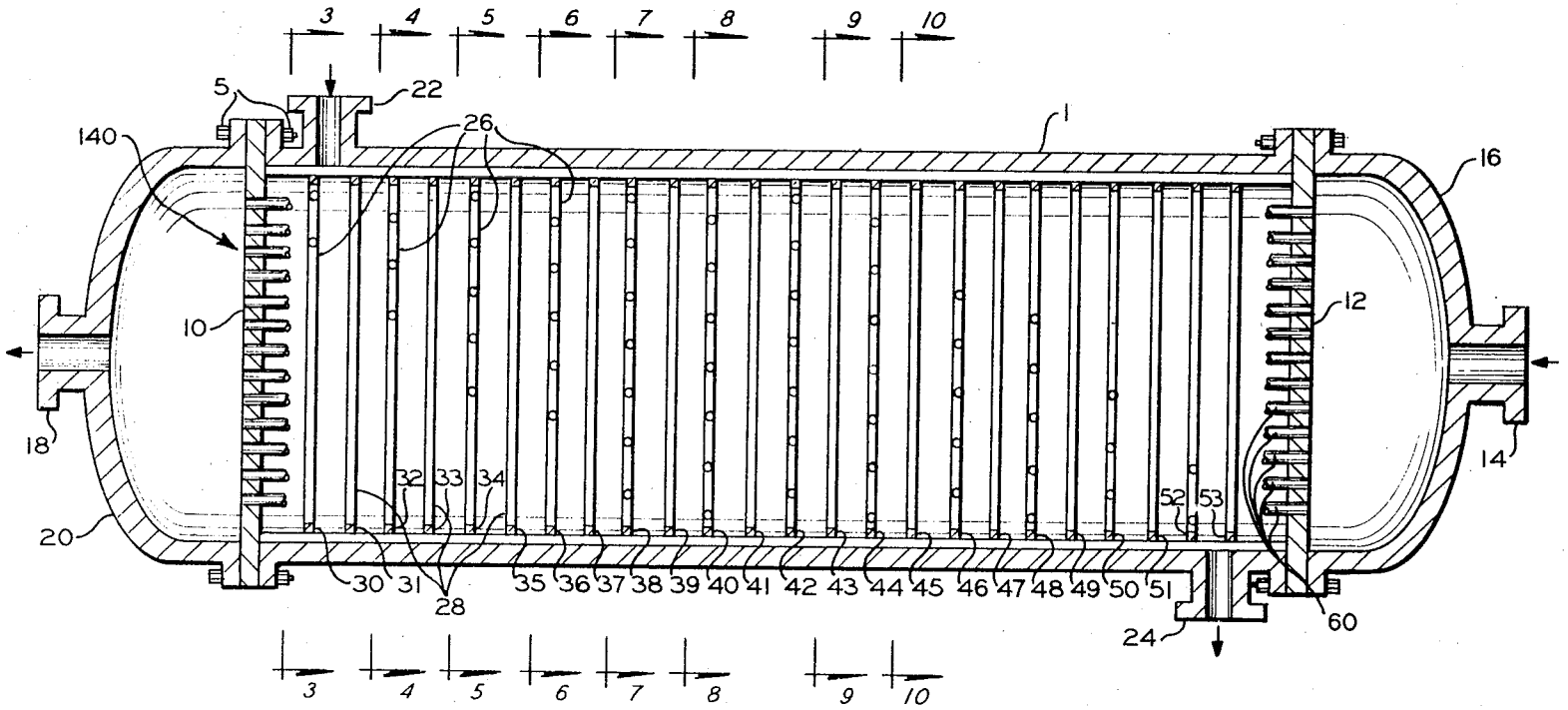
FIG. 2 is a cross sectional side view of one embodiment of the shell and tube heat exchanger of the invention.
Figure 2A:
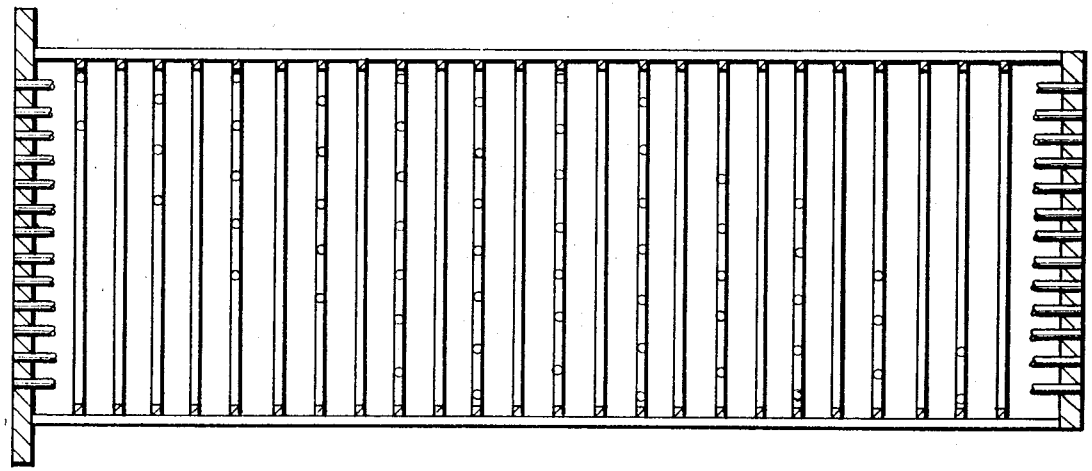
FIG. 2*a* is a cross sectional side view of one embodiment of the tube bundle of the invention.

The invention will now be described in detail making specific reference to the remainder of the drawings. FIG. 2 illustrates a shell and tube heat exchanger constructed in accordance with the present invention. Shell 1 is a vessel having a first tube sheet 10 and a second tube sheet 12 positioned at opposite ends of the vessel as well as an inlet means 22 and outlet means 24 which are also positioned at opposite ends of the vessel. The vessel can be any suitable shape such as for example a cylinder, a cube, and the like. Commonly, for ease of construction and efficient heat exchange, the vessel employed is a cylinder having a first axis defined by the longitudinal axis of the vessel, hereinafter referred to as the longitudinal axis, a second axis defined by the lateral axis of the vessel, hereinafter referred to as the lateral axis, and a third axis which is orthogonal to the first and second axes, hereinafter referred to as the orthogonal axis. Preferably, the first and second tube sheets are positioned substantially perpendicular with respect to the first axis, i.e., the longitudinal axis of the vessel, and substantially parallel to the second and third axes, i.e., the lateral and orthogonal axes. In addition, the tube sheets are generally positioned so they are substantially parallel to one another. Within the shell, a plurality of tubes 60 extend along the length of the shell from the first tube sheet to the second tube sheet, and are positioned substantially perpendicular with respect to the tube sheets. The tubes 60 are positioned so as to form a tube bundle that when viewed from the end forms an array in two dimensions having a plurality of substantially parallel rows and a plurality of substantially parallel columns.

For ease of construction, removal and replacement, the supported tube bundle of the invention can be assembled outside the shell of the shell and tube heat exchanger, for example, as shown in FIG. *2a*. The tube bundle has a first end and a second end and is formed from a plurality of parallel tubes. The plurality of parallel tubes form at least a first plurality of parallel tube rows with lanes between the rows and at least a first plurality of parallel tube columns with lanes between the columns. The support elements, to be described more fully below, are positioned in the lanes between the parallel tube rows and columns.

The tube bundle can be envisioned as being divided into a first end portion, a center portion and a second end portion. The first end portion comprises about 30% of the longitudinal length of the tubing bundle originating from the first end of the tube bundle, while the second end portion comprises about 30% of the longitudinal length of the tubing bundle originating from the second end of the tube bundle.

The tube bundle is provided with a support means comprising a plurality of rod baffle sets. Each rod baffle set comprises an outer ring having a plurality of support elements attached thereto, forming parallel chords with the outer ring. In accordance with the invention, the density of support elements per unit length of the tubing bundle in the first end portion and in the second end portion of the tubing bundle is less than the density of support elements per unit length of the tubing bundle in the center portion of the tubing bundle. In this manner, a greater density of support elements is provided in that portion of the tube bundle where shell fluid flow of a shell and tube heat exchanger tends to channel, i.e., the "normal" path, than in that portion of the tube bundle where flow tends to by-pass. Thus, a greater impedance to fluid flow in the normal path compared to the by-passed path is provided.

Although one skilled in the art can readily determine appropriate support element densities to employ, the following values are provided for additional guidance. It is recommended that the relative density of support elements in the first end portion and the second end portion of the tube bundle be maintained within a range of about 0.2 to about 0.9 relative to the density of support elements in the center portion of the tube bundle which is given a value of 1.0. Support element densities less than the lower limit provides insufficient tube bundle support while support element densities greater than the upper limit provides insignificant change in impedance to fluid flow.

Once the supported tube bundle as described hereinabove (and in greater detail below with reference to the assembled shell and tube heat exchanger) has been assembled, a first and second tube sheet can be attached by suitable means to the first end and second end, respectively, of the tube bundle. The supported tube bundle with tube sheets such a shown, for example, in FIG. *2a*, can then be inserted into a suitable vessel, such as for example, shell 1.

A shell and tube heat exchanger provides indirect heat exchange between two fluids, i.e., the two fluids do not come into contact with one another as they pass through the heat exchanger. Tube fluid is introduced via inlet means 14 on bonnet 16, passes through a plurality of tubes 60 and is removed via outlet means 18 on bonnet 20. The assembly of shell 1, tube sheets 10 and 12 and bonnets 16 and 20 is held together by bolts 5.

Shell fluid is introduced via inlet means 22. Although inlet means 22 is shown here for purposes of illustration as being located at the top of shell 1, in accordance with the invention, the inlet can be located at the bottom or side of the shell, or at various positions in between. In addition, while inlet 22 is shown positioned parallel to the orthogonal axis, i.e., orthogonal to the longitudinal and lateral axes, there is no limitation on the orientation with which the inlet means may be positioned with respect to the longitudinal and lateral axes. Thus, tangential entry, axial entry and the like can be employed.

Shell fluid travels through shell 1 while contacting the plurality of tubes 60 as well as the first plurality of rod baffles 26. The term "rod baffle", as employed herein, refers to a bundle of substantially parallel rods, and the term "rod baffle set" refers to a bundle of substantially parallel rods mounted on a retaining ring. Optionally, a second plurality of rod baffles 28 comprising substantially parallel rods and a retaining ring will also be present in the shell for the shell fluid to encounter during its flow therethrough. Shell fluid is removed via outlet means 24. Although outlet means 24 is shown here for purposes of illustration as being located at the bottom of shell 1, in accordance with the invention, the outlet can be located at the top or side of the shell, or at various positions in between. In addition, while outlet 24 is shown positioned parallel to the orthogonal axis, i.e., orthogonal to the longitudinal and lateral axes, there is no limitation on the orientation with which the outlet means may be positioned with respect to the longitudinal and lateral axes. Generally, the distance of inlet means 22 and outlet means 24 to the first and second tube sheets, respectively, is less than about 30% of the longitudinal length of the tube bundle.

The first plurality of rod baffles 26 comprises a plurality of substantially parallel rods in a plane, wherein the plane is preferably positioned substantially parallel to both the lateral axis and the orthogonal axis while being substantially perpendicular to the longitudinal axis, i.e., the individual rods of the first plurality of rod baffles 26 are oriented substantially perpendicular to the lateral axis. While the first plurality of rod baffles 26 are shown herein for purposes of illustration as being either parallel or perpendicular to the axes defined by the vessel, it is within the scope of the invention for the orientation of the rod baffles to vary as much as 45 degrees from the angle shown in the figure. In accordance with the invention, the number and position of the rods in each of the individual rod baffles which comprise the plurality of rod baffles 26 vary in such a manner so as to at least partially impede the flow of shell fluid through the normal flow path, i.e., areas in which shell flow tends to channel, thereby diverting a portion of shell fluid flow to normally by-passed areas, i.e., less impeded areas in the vicinity of inlet means 22 and outlet means 24. This is accomplished by employing a lower density of rods in the first end portion and second end portion of the tube bundle than in the center portion of the tube bundle.

When used, the second plurality of rod baffles 28 comprises a plurality of substantially parallel rods in a plane, wherein the plane is preferably positioned substantially parallel to both the lateral axis and the orthogonal axis while being substantially perpendicular to the longitudinal axis. As discussed above with respect to the first plurality of rod baffles 26, the second plurality of rod baffles 28 may similarly vary up to about 45 degrees from the angular orientation shown in the figures with respect to each of the axes defined previously. The parallel rods of the second plurality of rod baffles 28 and the parallel rods of the first plurality of rod baffles 26 will form at least a 30 degree angle with respect to one another when the rod baffles are positioned in planes parallel to one another. It is also to be understood that the rod baffles can be positioned in non-parallel planes, i.e., at angles to one another, without departing from the scope or spirit of the present invention. The angle formed by the first and second plurality of rod baffles will vary with the pitch of the rows and columns of the tubes in the tubing bundle 140. The pitch of the tubes 60 in tubing bundle 140 can be, for example, square, triangular, hexagonal, and the like. Thus, if the tubes 60 are laid out in a square pitch, the rods of the plurality of first rod baffles will form a 90 degree angle with respect to the rods of the plurality of second rod baffles. If, however, the tubes 60 are laid out, for example, in a triangular pitch or a hexagonal pitch, the rods of the plurality of first rod baffles will form a 60 degree angle with respect to the rods of the plurality of second rod baffles.

The parallel rods of the first and second plurality of rod baffles 26 and 28 can conveniently be mounted on rings, such as for example rings 30–53 as illustrated in FIG. 2. The rod baffle surrounded by an outer ring such as rings 30–53 is referred to herein as a rod baffle set. The rod baffle sets are placed in shell 1 between first tube sheet 10 and second tube sheet 12 and, in a preferred embodiment, the plane defined by the parallel rods and the outer ring is substantially parallel to the tube sheets. It should be pointed out that the rod baffle sets can be positioned in non-parallel planes, i.e., at angles to one another, without departing from the scope or spirit of the present invention. The rods of each rod baffle set cooperate with the outer ring (30–53) to form a plurality of parallel chords with the outer ring. As discussed below in more detail with respect to FIGS. 3–10, rings 30–53 surround the plurality of tubes 60.

When a first and second plurality of rod baffles are employed in shell 1, it is preferred that the members of the first plurality and the members of the second plurality of rod baffles be placed in the shell in alternating fashion. Thus, as shown in FIG. 2, the members of the first plurality of rod baffles 26 are represented by the rod baffle sets which are mounted on even numbered rings (30, 32, 34, etc.) while the second plurality of rod baffles 28 are represented by the rod baffle sets which are mounted on odd numbered rings (31, 33, 35, 37, etc.)

Those skilled in the art will immediately recognize that the number of tubes comprising tubing bundle 140 as shown in the figures are abnormally small. A commercial heat exchanger may comprise, for example, a bundle of 1,000 tubes (tubes 60) or more, with rod baffle sets spaced about 2 to about 18 inches apart, depending on the heat exchange purpose for which the tube bundle is to be employed. For example, it would be desirable when employing a shell and tube heat exchanger for cooling gases to provide rod baffle sets from about 2 to about 10 inches apart; while in a reboiler, the spacing between the rod baffle sets could be from about 6 to about 18 inches apart. Obviously, the number of rod baffle sets employed in a commercial scale shell and tube heat exchanger could be more than the 24 illustrated in FIG. 2.

Figure 3:
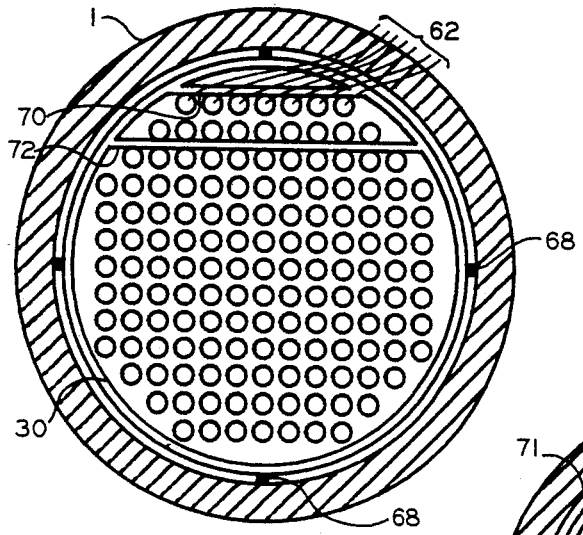
FIG. 3 is a partial end view taken along line 3—3 of FIG. 2 showing a rod baffle set of the invention.

Looking now in more detail at how shell fluid flow is diverted from the normal flow path (shown in FIG. 1) to the normally by-passed areas, attention is drawn to FIG. 3 wherein a partial end view taken along line 3—3 of the shell and tube heat exchanger of the invention is shown. Ring 30 is positioned inside shell 1, held in place by alignment or spacing elements 68, which can be rods, bars, strips and the like. Ring 30 is part of the rod baffle set nearest inlet means 22 wherein the plane of the ring is substantially parallel to both the lateral axis and the orthogonal axis while the rods of the rod baffle set are substantially perpendicular to the longitudinal axis. Uppermost rod 70 is positioned directly above the highest row of tubes, designated as tubes 62. The next rod 72, is placed in the lane between the second and third rows of tubes.

The rod positioning shown, i.e. rods positioned in the lane between alternate rows of tubes, represents the preferred mode of positioning support elements or rods in the shell and tube heat exchanger of the invention. The same alternating mode of positioning rods is employed in each of FIGS. 4–10 as well.

Although only two rods are shown on the rod baffle set including ring 30, the reader is reminded that the description provided herein is merely illustrative. Thus, FIG. 3, in combination with FIGS. 4–8, is intended to illustrate how one can achieve increased heat exchange efficiency by providing a higher density of rods laterally adjacent to the inlet side of the shell compared to the portion of the shell laterally opposite the inlet side of the shell. In the manner shown, a greater density of rods is provided in the normal fluid flow path i.e., the center portion of the tube bundle than in the normally by-passed area, i.e., the first end portion and the second end portion of the tube bundle, thereby increasing the impedance to flow in the normal fluid flow path and increasing the flow in the normally by-passed area.

Figure 4:
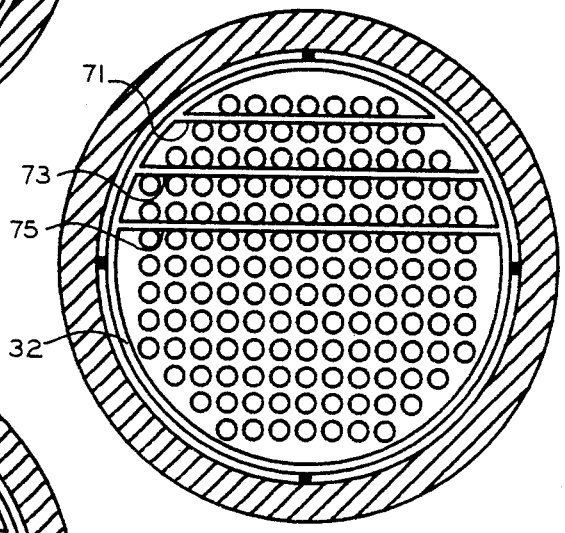
FIG. 4 is a partial end view taken along line 4—4 of FIG. 2 showing a rod baffle set of the invention.

Turning now to FIG. 4, it is seen that ring 32, which is part of the rod baffle set next nearest to inlet means 22 wherein the plane of the ring is substantially parallel to both the lateral axis and the orthogonal axis; while the 3 rods (71, 73, 75) of the rod baffle set are substantially perpendicular to the longitudinal axis. While the absolute number of rods is relatively unimportant, the important distinction between the rod baffle sets comprising rings 30 and 32 is that the rod baffle set including ring 32 provides for an increase in the density of rods which shell fluid travelling the normal fluid flow path encounters compared to the density of rods which shell fluid travelling the normally by-passed areas encounters. This can be accomplished, for example, by providing at least one more rod on the rod baffle set including ring 32 compared to the number of rods provided on the rod baffle set including ring 30. Note that the increase in rod density occurs both with respect to lateral and longitudinal movement away from inlet means 22.

Ring 32 is shown with rods 71, 73 and 75 positioned in the lanes below the first, third and fifth rows of tubes respectively. This represents a preferred means of positioning rods with respect to alternating rod baffle sets (compared to the positioning of rods 70 and 72 on ring 30).

Figure 5:
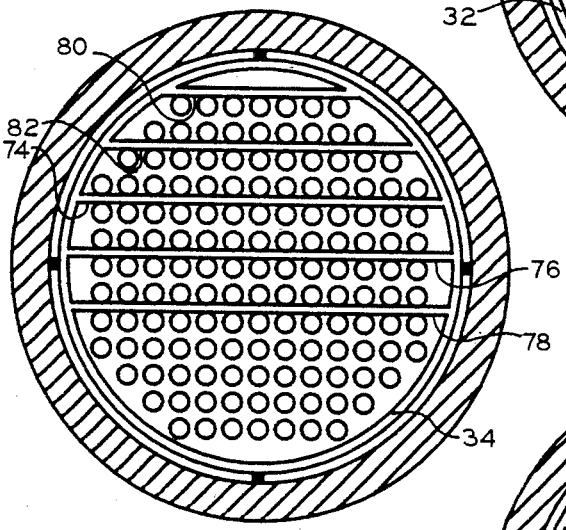
FIG. 5 is a partial end view taken along line 5—5 of FIG. 2 showing a rod baffle set of the invention.

Referring now to FIG. 5, which shows the rod baffle set third nearest inlet means 22 wherein the plane of the ring is substantially parallel to both the lateral axis and the orthogonal axis while the 5 rods (74, 76, 78, 80, 82) of the rod baffle set are substantially perpendicular to the longitudinal axis. First, note that the rods are positioned in the lane between alternating rows of tubes, and are positioned in the lane between different rows compared to the rods of ring 32. Thus, uppermost rod 80 is positioned above the uppermost row of tubes 62. The second rod 82 is positioned in the lane below the second row and above the third row of tubes, and so on. Next, note that the density of rods is increased once again as one moves further away from inlet means 22, along both the longitudinal and lateral axes.

Figure 6:
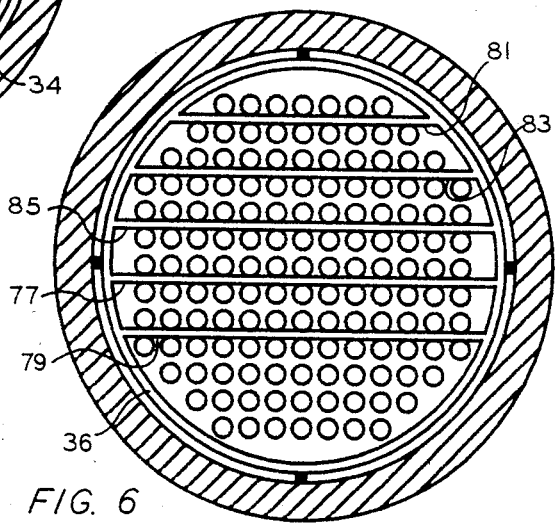
FIG. 6 is a partial end view taken along line 6—6 of FIG. 2 showing a rod baffle set of the invention.

FIG. 6 demonstrates how the density of rods can be even further increased in the normal fluid flow path without increasing the number of rods on the next adjacent rod baffle set (comparing ring 36 to previously described ring 34). Thus, by positioning the rods attached to ring 36 (rods 77, 79, 81, 83, 85) so that the rods are placed one tubing row lower than were the rods on ring 34, the density of rods along the normal flow path is further increased. Ring 36 represents the rod baffle set fourth nearest inlet means 22 wherein the plane of the ring is substantially parallel to both the lateral axis and the orthogonal axis while the rods of the rod baffle set are substantially perpendicular to the longitudinal axis and to the orthogonal axis.

Figure 7:
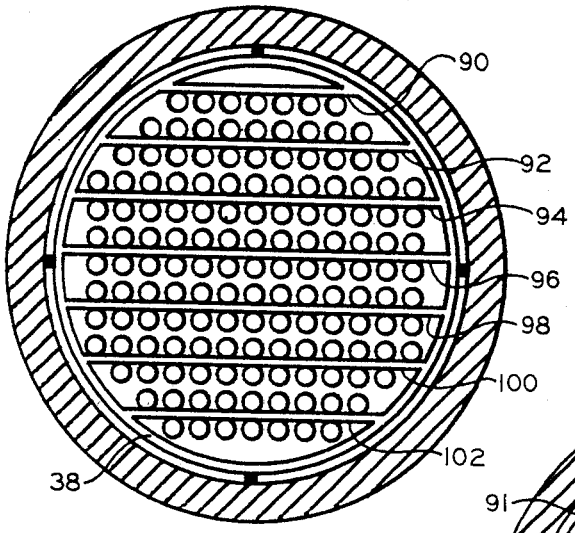
FIG. 7 is a partial end view taken along line 7—7 of FIG. 2 showing a rod baffle set of the invention.
Figure 8:
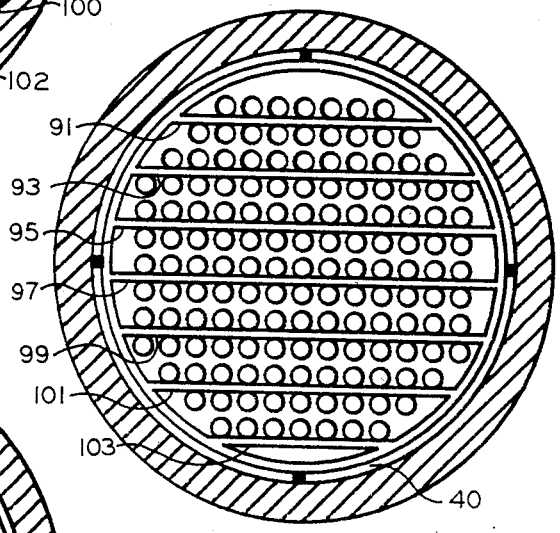
FIG. 8 is a partial end view taken along line 8—8 of FIG. 2 showing a rod baffle set of the invention.

FIGS. 7 and 8 illustrate the preferred orientation of rods in the center portion of the shell and tube heat exchanger of the invention where a uniform distribution of rods is employed. Thus, the upper most rod 90 of the rod baffle set including ring 38 is positioned above the highest row of tubes 62 whereas the uppermost rod 91 of the rod baffle set including ring 40 is positioned in the lane below the highest row of tubes 62. In both cases, additional rods (rods 92 through 103) are positioned in the lane between alternating rows of tubes.

Due to the dimension chosen for purposes of illustration, note on FIG. 2 that the rod baffle sets including rings 38 and 42 will have the identical configuration of rods and that the rod baffle sets including rings 40 and 44 will similarly have the identical configuration of rods.

As the fluid flow approaches outlet means 24 in prior art shell and tube heat exchangers, the same non-uniform flow of fluid occurs, creating a by-passed area in the portion of the shell laterally opposite the outlet side of the shell. Thus, in accordance with the invention, the same variation of rod density as described above is created at the outlet end of the shell by positioning a higher density of rods in the normal flow path, i.e., the center portion of the shell and tube heat exchanger, than in the normally by-passed flow path, i.e., the first end portion and the second end portion of the shell and tube heat exchanger. The rod baffle set including ring 52, therefore, is seen to have the same rod disposition as the rod baffle set including ring 30, except the lowest rod is positioned below the bottommost row of tubes, i.e., the inverse of the rod baffle set including ring 30. Similarly, the rod baffle set including ring 50 has the same rod disposition as the rod baffle set including ring 32 and is positioned in shell 1 of the shell and tube heat exchanger in the inverse orientation of the rod baffle set including ring 32. Likewise, the rod baffle set including ring 48 has the same rod disposition as the rod baffle set including ring 34 and the rod baffle set including ring 46 has the same rod disposition as the rod baffle set including ring 36. In such a manner, fluid flow in the normal flow path in the vicinity of outlet means 24 is impeded with respect to fluid flow in the normally by-passed area. Thus, improved heat exchange is achieved by diverting a portion of the fluid from the normal flow path to the normally by-passed area in the vicinity of the outlet means. Those skilled in the art will recognize, as pointed out previously, that the first rod baffle set nearest inlet means 22 or outlet means 24 of the plurality of rod baffles 26 can contain a greater or lesser number of rods than used herein, keeping in mind the goal to achieve a reduced impedance to flow in the normally by-passed zone compared to the normal flow path.

Figure 9:
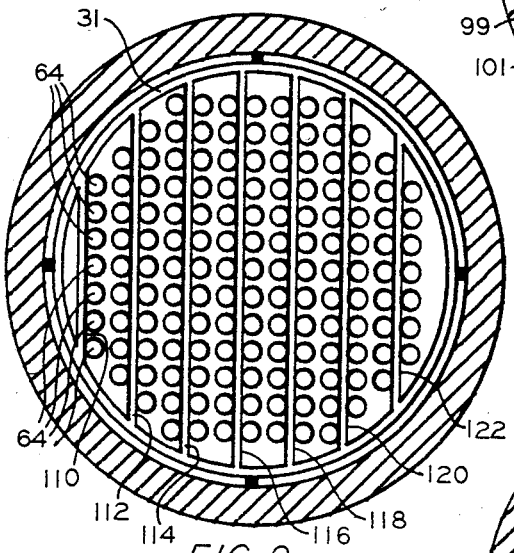
FIG. 9 is a partial end view taken along line 9—9 of FIG. 2 showing a rod baffle set of the invention.
Figure 10:
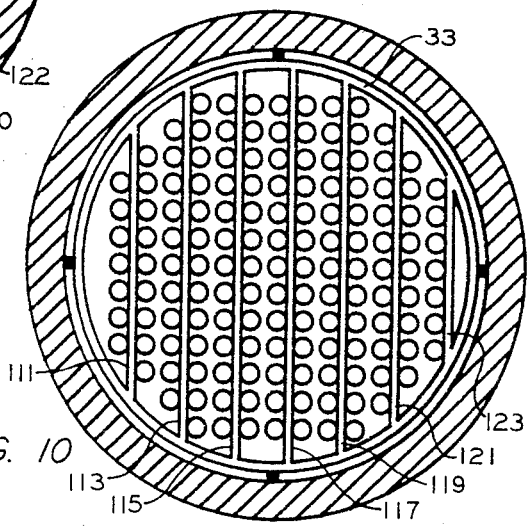
FIG. 10 is a partial end view taken along line 10—10 of FIG. 2 showing a rod baffle set of the invention.

FIGS. 9 and 10 illustrate the preferred positioning of rods when a second plurality of rod baffle sets comprising a plurality of substantially parallel rods is employed in the practice of the present invention. Rods 110, 112, 114, 116, 118, 120 and 122 are positioned in the lanes between alternating columns of tubes, beginning with the first rod (110) to the left of the left-most column of tubes, designated as tubes 64, as viewed along line 9—9 of FIG. 2. The rod orientation on the rod baffle set including ring 31 as shown in FIG. 9 is identical to the rod orientation on rod baffle sets including rings 35, 39, 43, 47 and 51. FIG. 10 illustrates the preferred rod orientation on those rings which support the second plurality of rod baffle sets comprising a plurality of substantially parallel rods which alternate with rod baffle sets including rings 35, 39, 43, 47 and 51 as described above. Thus, rod baffle set including ring 33 (as well as rod baffle set including rings 37, 41, 45, 49 and 53) viewing from left-to-right, has the left-most rod (111) positioned to the right of the left-most column of tubes, designated as tubes 64. Rods 113, 115, 117, 119, 121 and 123 are then positioned in the lanes between alternating columns of tubes with respect to rod 111.

In order to more fully describe the invention, the following calculated example is provided.

EXAMPLE (Calculated)

Shell Fluid (Water):
Gallons/hr.,: 200
Temperature in, °F.,: 90
Temperature out, °F.,: 160
Tube Fluid (Water):
Gallons/hr.,: 200
Temperature in, °F.,: 185
Temperature out, °F.,: 115

Using the rod baffle set arrangement of FIG. 2 for improved shell fluid contact with the tubes below the inlet and above the outlet it is estimated that about 5 to 10 percent additional heat exchange is realized.

Reasonable variations from and modifications of this invention as disclosed herein are contemplated to be within the scope of patent protection desired and sought.

That which is claimed is:

1. Apparatus comprising:

(a) a tube bundle having a longitudinal length, a first end and a second end, wherein said tube bundle is formed from a plurality of parallel tubes arranged in at least a first plurality of parallel tube rows with lanes between the rows and at least a first plurality of parallel tube columns with lanes between the columns, wherein said tube bundle has a first end portion, a center portion and a second end portion, wherein said first end portion comprises about 30% of the longitudinal length of the tube portion comprises about 30% of the longitudinal length of the tube bundle originating from said first ends and wherein said second end portion comprises about 30% of the longitudinal length of the tube bundle originating from said second end; and (b) a support means comprising a plurality of rod baffle sets wherein each rod baffle set comprises an outer ring having a plurality of support elements attached thereto to form parallel chords with said outer ring, wherein the density of support elements per unit length of the tube bundle in the first end portion and in the second end portion is less than the density of support elements per unit length of the tube bundle in the center portion of the tube bundle.

2. Apparatus in accordance with claim 1 wherein the density of support elements per unit length of the tube bundle in the first end portion and in the second end portion relative to the density of support elements in the center portion varies between 0.2 and 0.9 where the density of support elements per unit length of the tube bundle in the center portion is designated as 1.0.

3. Apparatus in accordance with claim 1 further comprising:

(c) a first and a second tube sheet positioned at opposite ends of said bundle wherein said first and said second tube sheets are substantially perpendicular with respect to the longitudinal axis of said tube bundle and wherein said first and said second tube sheets are substantially parallel to one another.

4. Apparatus in accordance with claim 3 further comprising:

(d) a shell having a periphery and a passage therethrough for the passage of shell fluid; wherein said tubes of said tube bundle extend through said shell from said first tube sheet to said second tube sheet;

(e) an inlet means for introducing said shell fluid into said shell; wherein the distance of said inlet means to said first end of said tube bundle is less than about 30 percent of the longitudinal length of said tube bundle; and (f) an outlet means for removing said shell fluid from said shell; wherein the distance of said outlet means to said second end of said tube bundle is less than about 30 percent of the longitudinal length of said tube bundle.

5. Apparatus in accordance with claim 4 wherein said inlet means for introducing said shell fluid into said shell is positioned at the upper portion of the periphery of said shell and near the first end of said tube bundle; and said outlet means for removing said shell fluid from said shell is positioned at the lower portion of the periphery of said shell and near the second end of said tube bundle.

6. Apparatus in accordance with claim 5 wherein said shell is a cylinder; wherein the longitudinal axis of said cylinder is substantially horizontal; wherein said plurality of tubes are substantially horizontal; wherein said support elements are substantially horizontal; and wherein said first plurality of rod baffles are substantially vertical.

7. Apparatus in accordance with claim 6 having a first through thirteenth highest horizontal row of tubes and a first through fifth rod baffle sets nearest the inlet means; wherein the rod baffle set nearest to said inlet means has exactly 2 horizontal support elements; wherein the first of said support elements is positioned directly above the highest horizontal row of said tubes and the second of said support elements is positioned between the second highest and third highest horizontal rows of said tubes;

wherein the rod baffle set second neartest to said inlet means has exactly 3 horizontal support elements wherein the first of said support elements is positioned between the highest and second highest horizontal rows of said tubes; wherein the second of said support elements is positioned between the third highest and fourth highest horizontal rows of said tubes; wherein the third of said support elements is positioned between the fifth highest and sixth highest horizontal rows of said tubes;

wherein the rod baffle set third nearest to said inlet means has exactly 5 horizontal support elements wherein the first of said support elements is positioned directly above the highest horizontal row of said tubes; wherein the second of said support elements is positioned between the second highest and third highest horizontal rows of said tubes; wherein the third of said support elements is positioned between the fourth highest and fifth highest horizontal rows of said tubes; wherein the fourth of said support elements is positioned between the sixth highest and seventh highest horizontal rows of said tubes; wherein the fifth of said support elements is positioned between the eighth highest and ninth highest horizontal rows of said tubes;

wherein the rod baffle set fourth nearest to said inlet means has exactly 5 support elements wherein the first of said support elements is positioned between the highest and second highest horizontal rows of said tubes; wherein the second of said support elements is positioned between the third highest and fourth highest horizontal rows of said tubes; wherein the third of said support elements is positioned between the fifth highest and sixth highest horizontal rows of said tubes; wherein the fourth of said support elements is positioned between the seventh highest and eighth highest horizontal rows of said tubes; wherein the fifth of said support elements is positioned between the ninth highest and tenth highest horizontal rows of said tubes;

wherein the rod baffle set fifth nearest to said inlet means has exactly 7 support elements wherein the first of said support elements is positioned directly above the highest horizontal row of said tubes; wherein the second of said support elements is positioned between the second highest and third highest horizontal rows of said tubes; wherein the third of said support elements is positioned between the fourth highest and fifth highest horizontal rows of said tubes; wherein the fourth of said support elements is positioned between the sixth highest and seventh highest horizontal rows of said tubes; wherein the fifth of said support elements is positioned between the eighth highest and ninth highest horizontal rows of said tubes; wherein the sixth of said support elements is positioned between the tenth highest and eleventh highest horizontal rows of said tubes; and wherein the seventh of said support elements is positioned between the twelfth highest and thirteenth highest horizontal rows of said tubes.

8. A shell and tube heat exchanger in accordance with claim 7 having a first through thirteenth lowest horizontal row of tubes and a first through fifth rod baffle sets nearest the outlet means; wherein the rod baffle set nearest to said outlet means has exactly 2 horizontal support elements wherein the first of said support elements is positioned directly below the lowest horizontal row of said tubes and the second of said support elements is positioned between the second lowest and third lowest horizontal rows of said tubes;

wherein the rod baffle set second nearest to said outlet means has exactly 3 horizontal support elements wherein the first of said support elements is positioned between the lowest and second lowest horizontal rows of said tubes; wherein the second of said support elements is positioned between the third lowest and fourth lowest horizontal rows of said tubes; wherein the third of said support elements is positioned between the fifth lowest and sixth lowest horizontal rows of said tubes;

wherein the rod baffle set third nearest to said outlet means has exactly 5 horizontal support elements wherein the first of said support elements is positioned directly below the lowest horizontal row of said tubes; wherein the second of said support elements is positioned between the second lowest and third lowest horizontal rows of said tubes; wherein the third of said support elements is positioned between the fourth lowest and fifth lowest horizontal rows of said tubes; wherein the fourth of said support elements is positioned between the sixth lowest and seventh lowest horizontal rows of said tubes; wherein the fifth of said support elements is positioned between the eighth lowest and ninth lowest horizontal rows of said tubes;

wherein the rod baffle set fourth nearest to said outlet means has exactly 5 support elements wherein the first of said support elements is positioned between the lowest and second lowest horizontal rows of said tubes; wherein the second of said support elements is positioned between the third lowest and fourth lowest horizontal rows of said tubes; wherein the third of said support elements is positioned between the fifth lowest and sixth lowest horizontal rows of said tubes; wherein the fourth of said support elements is positioned between the seventh lowest and eighth lowest horizontal rows of said tubes; wherein the fifth of said support elements is positioned between the ninth lowest and tenth lowest horizontal rows of said tubes;

wherein the rod baffle set fifth nearest to said outlet means has exactly 7 support elements wherein the first of said support elements is positioned directly below the lowest horizontal row of said tubes; wherein the second of said support elements is positioned between the second lowest and third lowest horizontal rows of said tubes; wherein the third of said support elements is positioned between the fourth lowest and fifth lowest horizontal rows of said tubes; wherein the fourth of said support elements is positioned between the sixth lowest and seventh lowest horizontal rows of said tubes; wherein the fifth of said support elements is positioned between the eighth lowest and ninth lowest horizontal rows of said tubes; wherein the sixth of said support elements is positioned between the tenth lowest and eleventh lowest horizontal rows of said tubes; and wherein the seventh of said support elements is positioned between the twelfth lowest and thirteenth lowest horizontal rows of said tubes.

9. Apparatus in accordance with claim 4 wherein said support elements of any given rod baffle set are positioned between alternating tubes of said tube bundle.

10. Apparatus in accordance with claim 4 further comprising a second plurality of rod baffle sets comprising substantially parallel support elements in a plane; wherein each of the support elements of said second plurality of rod baffle sets forms at least a 30 degree angle with respect to each of the support elements of said first plurality of rod baffle sets.

11. Apparatus in accordance with claim 10 wherein the support elements of said first plurality of rod baffle sets are positioned between alternating tubes of said tube bundle; wherein the support elements of said second plurality of rod baffle sets are positioned between alternating tubes of said tube bundle; and wherein the members of the first plurality of rod baffle sets and the members of the second plurality of rod baffle sets alternate in said shell.

12. A shell and tube heat exchanger comprising:

(a) A shell having a longitudinal axis, a lateral axis and an orthogonal axis, and a passage therethrough for the passage of shell fluid;

(b) a first and a second tube sheet positioned at opposite ends of said shell; wherein said first and said second tube sheets are substantially perpendicular with respect to the longitudinal axis of said shell; and wherein said first and said second tube sheets are substantially parallel to one another;

(c) a plurality of tubes extending through said shell from said first tube sheet to said second tube sheet; wherein said tubes are substantially perpendicular to said tube sheets; wherein said tubes form a tube bundle having a longitudinal length, a first end and a second end, wherein said tube bundle is formed from a plurality of parallel tubes arranged in at least a first plurality of parallel tube rows with lanes between said tube rows and at least a first plurality of parallel tube columns with lanes between the columns, wherein said tube bundle has a first end portion, a center portion and a second end portion, wherein said first end portion comprises about 30% of the longitudinal length of the tube bundle originating from said first end and wherein said second end portion comprises about 30% of the longitudinal length of the tube bundle originating from said second end; and (d) an inlet means for introducing said shell fluid into said shell; wherein the distance of said inlet means to said first end of said tube bundling is less than about 30 percent of the longitudinal length of said tube bundle;

(e) an outlet means for removing said shell fluid from said shell; wherein the distance of said outlet means to said second end of said tube bundle is less than about 30 percent of the longitudinal length of said tube bundle;

(f) at least a first plurality of rod baffles comprising substantially parallel rods in a plane; wherein said plane is substantially parallel to the lateral axis of said shell and the orthogonal axis of said shell; wherein the parallel rods of said rod baffles are substantially perpendicular to the longitudinal axis of said shell; and wherein the density of said rods in said rod baffles comprising substantially parallel rods is less in the first end portion of the tube bundle than in the center portion of said tube bundle.

13. A shell and tube heat exchanger in accordance with claim 12 wherein the density of said rods in said rod baffles comprising substantially parallel rods is less in the second end portion of the tube bundle than in the center portion of said tube bundle.

14. A shell and tube heat exchanger in accordance with claim 13 wherein the density of rods of those rod baffles in the first end portion and the second end portion of said tube bundle is greater laterally adjacent to said inlet means and said outlet means than the density of said rods laterally opposed to said inlet means and said outlet means.

15. A shell and tube heat exchanger in accordance with claim 12 wherein the density of rods per unit length of the tubing bundle in the first end portion and in the second end portion relative to the density of support elements in the center portion varies between 0.2 and 0.9 where the density of rods per unit length of the tubing bundle in the center portion is designated as 1.0.

16. Apparatus in accordance with claim 12 wherein said shell is a cylinder; wherein the longitudinal axis of said cylinder is substantially horizontal; wherein said plurality of tubes are substantially horizontal; wherein said support elements are substantially horizontal; and wherein said first plurality of rod baffles are substantially vertical.

17. A shell and tube heat exchanger in accordance with claim 16 wherein said first plurality of substantially vertical rod baffles are formed by positioning a plurality of rod baffles in said shell between said inlet means and said outlet means and substantially parallel to said tube sheets; wherein each of said first plurality of substantially vertical rod baffles comprises an outer ring surrounding said tubes and a substantially vertical bundle of substantially horizontal rods; and wherein said rods cooperate with said outer ring to form a rod baffle set, each rod baffle set forming a plurality of parallel chords with said outer ring.

18. A shell and tube heat exchanger in accordance with claim 12 further comprising a second plurality of rod baffles comprising substantially parallel rods in a plane; wherein each of the rods of said second plurality of rod baffles forms at least a 30 degree angle with respect to each of the rods of said first plurality of rod baffles; wherein the rods of said first plurality of rod baffles are positioned between alternating tubes of said plurality of tubes; wherein the rods of said second plurality of rod baffles are positioned between alternating tubes of said plurality of tubes; and wherein the members of the first plurality of rod baffles and the members of the second plurality of rod baffles alternate in said shell.

19. A method for improving the heat transfer efficienty of a shell and tube heat exchanger, wherein said shell and tube heat exchanger comprises;

(a) a shell having a longitudinal axis and a passage therethrough for the passage of shell fluid;

(b) a first and a second tube sheet positioned at opposite ends of said shell; wherein said first and said second tube sheets are substantially perpendicular with respect to the longitudinal axis of said shell; and wherein said first and said second tube sheets are substantially parallel to one another;

(c) a plurality of tubes extending through said shell from said first tube sheet to said second tube sheet; wherein said tubes are substantially perpendicular to said tube sheets; wherein said tubes form a tube bundle having a longitudinal length, a first end and a second end, wherein said tube bundle is formed from a plurality of parallel tubes arranged in at least a first plurality of parallel tube rows with lanes between said tube rows and at least a first plurality of parallel tube columns with lanes between the columns, wherein said tube bundle has a first end portion, a center portion and a second end portion, wherein said first end portion comprises about 30% of the longitudinal length of the tube bundle originating from said first end and wherein said second end portion comprises about 30% of the longitudinal length of the tube bundle originating from said second end; and (d) an inlet means for introducing said shell fluid into said shell; wherein the distance of said inlet means to said first end of said tube bundle is less than about 30 percent of the longitudinal length of said tube bundle;

(e) an outlet means for removing said shell fluid from said shell; wherein the distance of said outlet means to said second end of said tube bundle sheet is less than about 30 percent of the longitudinal length of said tube bundle; wherein said flow of shell fluid tends to channel and follow a channeled path thereby substantially bypassing areas in the first end portion and second end portion of the tube bundle; said method comprising:

positioning in said shell a plurality of rod baffles comprising substantially parallel rods; wherein the density of said rods in said center portion of said tube bundle is greater than the density of rods in said first end portion and second end portion of the tube bundle.

20. A method in accordance with claim 19 wherein the density of rods per unit length of the tubing bundle in the first end portion and in the second end portion relative to the density of support elements in the center portion varies between 0.2 and 0.9 where the density of rods per unit length of the tubing bundle in the center portion is designated as 1.0.

* * * * *